US011264686B2

(12) United States Patent
Cui et al.

(10) Patent No.: US 11,264,686 B2
(45) Date of Patent: Mar. 1, 2022

(54) DIELECTRIC FILTER AND COMMUNICATIONS DEVICE

(71) Applicant: HUAWEI TECHNOLOGIES CO., LTD., Guangdong (CN)

(72) Inventors: Zheng Cui, Dongguan (CN); Dan Liang, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 17/013,239

(22) Filed: Sep. 4, 2020

(65) Prior Publication Data

US 2020/0403287 A1 Dec. 24, 2020

Related U.S. Application Data

(63) Continuation of application No. PCT/CN2019/084142, filed on Apr. 24, 2019.

(30) Foreign Application Priority Data

Apr. 24, 2018 (CN) ..... 201810374218.1

(51) Int. Cl.
*H01P 1/202* (2006.01)
*H01P 1/20* (2006.01)
(Continued)

(52) U.S. Cl.
CPC ..... *H01P 1/2002* (2013.01); *H01P 1/2056* (2013.01); *H01P 7/10* (2013.01)

(58) Field of Classification Search
CPC ..... H01P 1/2002; H01P 1/202; H01P 1/20; H01P 1/205; H01P 1/208; H01P 1/2084;
(Continued)

(56) References Cited

U.S. PATENT DOCUMENTS 4,839,773 A 6/1989 Ishikawa et al.
5,764,115 A 6/1998 Hattori et al.
(Continued)

FOREIGN PATENT DOCUMENTS

CN 1388610 A 1/2003
CN 206148589 U 5/2017
(Continued)

OTHER PUBLICATIONS

Office Action issued in Chinese Application No. 201810374218.1 dated May 22, 2020, 13 pages (with English translation).
(Continued)

*Primary Examiner* — Stephen E. Jones
(74) *Attorney, Agent, or Firm* — Fish & Richardson P.C.

(57) ABSTRACT

This disclosure describes a dielectric filter and a communications device. In one example, the dielectric filter includes at least two dielectric resonators, a first through-hole is disposed between at least one pair of adjacent dielectric resonators, and the first through-hole is configured to cut a magnetic field between the at least one pair of adjacent dielectric resonators. In some implementations, a magnetic field distribution in the dielectric filter may be cut via the first through-hole, so that a magnetic field distribution area is reduced, and a high-order harmonic wave frequency can be increased, thereby improving a remote suppression capability and meeting the specification requirements.

20 Claims, 15 Drawing Sheets

(51) Int. Cl.
*H01P 7/10* (2006.01)
*H01P 1/205* (2006.01)

(58) Field of Classification Search
CPC ..... H01P 1/2086; H01P 7/10; H01P 7/105; H01P 1/2053; H01P 1/2056
See application file for complete search history.

(56) References Cited

U.S. PATENT DOCUMENTS

| | | | | |
|---|---|---|---|---|
| 5,929,725 | A * | 7/1999 | Toda | H01P 1/2056 333/202 |
| 6,163,237 | A * | 12/2000 | Toda | H01P 1/2056 333/206 |
| 2002/0190821 | A1 | 12/2002 | Tada et al. | |

FOREIGN PATENT DOCUMENTS

| | | | |
|---|---|---|---|
| CN | 206864585 | U | 1/2018 |
| JP | H07162205 | A | 6/1995 |
| WO | 2015068493 | A1 | 5/2015 |

OTHER PUBLICATIONS

PCT International Seach Report and Written Opinion issued in International Application No. PCT/CN2019/084142 dated Jul. 10, 2019, 11 pages (with English translation).
Extended European Search Report issued in European Application No. 19792436.8 dated Feb. 22, 2021, 7 pages.
Office Action issued in Indian Application No. 202047035385 dated Nov. 18, 2021, 6 pages.

* cited by examiner

DIELECTRIC FILTER AND COMMUNICATIONS DEVICE

This application claims priority to Chinese Patent Application No. 201810374218.1, filed with the Chinese Patent Office on Apr. 24, 2018, and entitled "DIELECTRIC FILTER AND COMMUNICATIONS DEVICE", which is incorporated herein by reference in its entirety.

TECHNICAL FIELD

This application relates to the field of communications technologies, and in particular, to a dielectric filter and a communications device.

BACKGROUND

With continuous development of communications technologies, a massive multiple-input multiple-output (massive (multiple-input multiple-output, MIMO)) system has an increasingly high requirement for a miniaturized on-board filter. The miniaturized on-board filter means that a miniaturized filter is directly welded on a circuit board to replace a larger cavity filter in a device, so that a size and a cost of the filter on the device can be reduced and a threshold of commercial use of the massive MIMO system can be lowered.

Currently, a most commonly used miniaturized filter that meets the foregoing requirements is a dielectric filter. The existing dielectric filter is formed by a coupling of several dielectric resonant cavities, in which each dielectric resonant cavity contains a dielectric resonator, so it can also be considered that the dielectric filter is formed by a coupling of several dielectric resonators. However, in such a dielectric filter, because of a coupling between every two dielectric resonators, an overall size of all dielectric resonators connected increases, and a magnetic field distribution area increases. As a result, a high-order harmonic wave frequency decreases and a remote suppression capability deteriorates. Consequently, specification requirements and user requirements cannot be met. Therefore, in practice, an additional low-pass filter needs to be added to work with the dielectric filter to meet a requirement of remote suppression capability.

In conclusion, the existing dielectric filter causes a decrease in a high-order harmonic wave frequency and causes a poor remote suppression capability, which cannot meet the specification requirements.

SUMMARY

This application provides a dielectric filter and a communications device, to solve a problem in the prior art that a dielectric filter causes a decrease in a high-order harmonic wave frequency and a poor remote suppression capability, and specification requirements cannot be met.

According to a first aspect, this application provides a dielectric filter, including at least two dielectric resonators, where a first through-hole is disposed between at least one pair of adjacent dielectric resonators, and the first through-hole is configured to cut a magnetic field between the at least one pair of adjacent dielectric resonators. In this way, a magnetic field distribution in the dielectric filter may be cut via the first through-hole, so that a magnetic field distribution area is reduced, and the high-order harmonic wave frequency can be increased, thereby improving the remote suppression capability and meeting specification requirements. In addition, the dielectric filter provided in this application is easy to implement and has a simple structure. After the dielectric filter provided in this application meets the specification requirements, a low-pass filter does not need to be used, so that a cost and a loss can be reduced.

In a possible design, the first through-hole penetrates the dielectric filter, one opening of the first through-hole is located on a first surface, and the other opening is located on a second surface; and the first surface and the second surface are respectively side surfaces on two sides of an arrangement direction of the at least two resonators in the dielectric filter. In this way, the first through-hole in this design is relatively easy to implement and has a relatively simple structure, so that a magnetic field distribution in the dielectric filter can be easily cut, and a magnetic field distribution area is reduced, thereby improving the high-order harmonic wave frequency.

In a possible design, the first through-hole is in communication with a through-hole group, and the through-hole group includes one or more second through-holes; and openings of all second through-holes are located on a side surface close to the top or bottom of the at least two dielectric resonators in the dielectric filter. In this way, an effect of cutting the magnetic field may be better, and further, an effect of increasing the high-order harmonic wave frequency may be better.

In a possible design, at least one non-through hole is disposed on the first through-hole, and one non-through hole is in communication with one second through-hole. In this way, an effect of cutting the magnetic field may be better, and further, an effect of increasing the high-order harmonic wave frequency may be better.

In a possible design, an internal surface of the at least one second through-hole is coated with a first metallic material. In this way, performance of the dielectric filter may be better.

In a possible design, an internal surface of the at least a non-through hole is coated with a second metallic material. In this way, performance of the dielectric filter may be better.

In a possible design, an internal surface of the first through-hole is coated with a third metallic material. In this way, performance of the dielectric filter may be better.

In a possible design, the first metallic material, the second metallic material and the third metallic material may be completely the same, or may be completely different. The three types of metallic materials may be metals such as silver and copper.

In a possible design, the first through-hole is a straight-through hole, a bent-through hole, an irregular through-hole, or the like.

In a possible design, one or more first through-hole are disposed between the at least one pair of adjacent dielectric resonators. In this way, a quantity of first through-holes may be set to adapt to a requirement of the dielectric filter for the high-order harmonic wave frequency.

In a possible design, the dielectric filter may be, but is not limited to, a TEM-type dielectric filter, or the like.

According to a second aspect, this application provides a communications device, where the communications device includes the foregoing dielectric filter. The communications device may include but is not limited to a base station, a terminal device, or the like.

DESCRIPTION OF EMBODIMENTS

Figure 1:
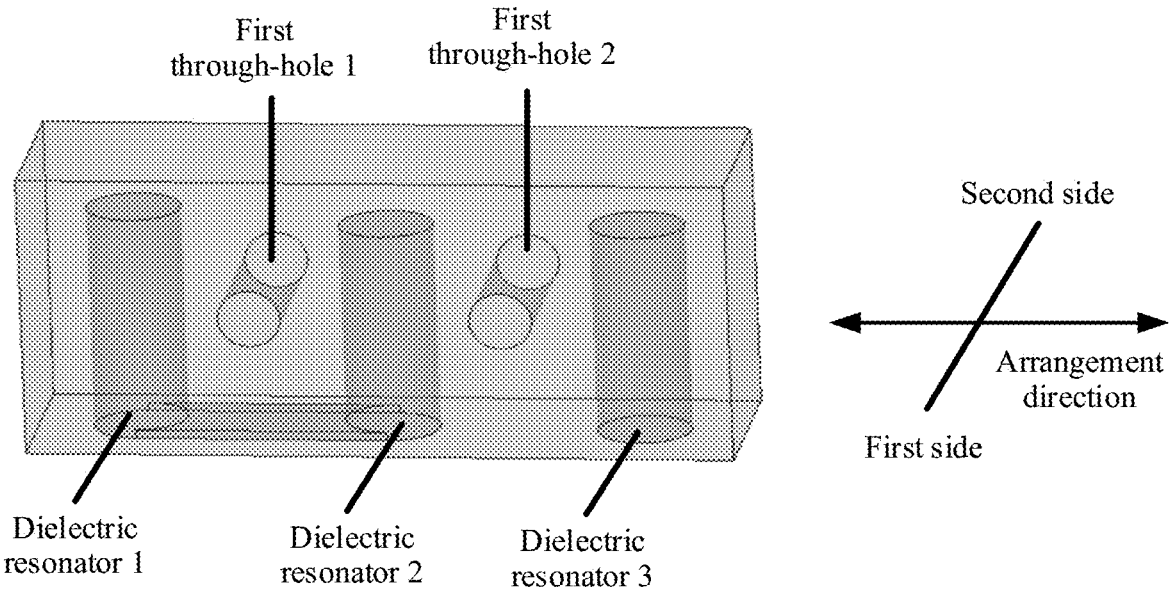
FIG. 1 is a schematic structural diagram of a dielectric filter according to this application.

The following further describes in detail this application with reference to accompanying drawings.

Embodiments of this application provide a dielectric filter and a communications device, to solve a problem in the prior art that a dielectric filter causes a decrease in a high-order harmonic wave frequency and a poor remote suppression capability, and specification requirements cannot be met.

In the description of this application, terms such as "first" and "second" are merely used for distinction and description, and shall not be understood as an indication or implication of relative importance or an indication or implication of an order.

It is well known that, in systems such as a communications system, a communications device such as a base station and a terminal device includes a filter. Currently, a dielectric filter is usually used to meet the requirements of low-cost and miniaturization. The dielectric filter includes at least two dielectric resonators, and the at least two dielectric resonators are in a sequential coupling arrangement. In practice, because of a coupling between the at least two dielectric resonators in the dielectric filter, a magnetic field in the dielectric filter is distributed in a range including all the dielectric resonators, which causes a decrease in a high-order harmonic wave frequency and deteriorates a remote suppression capability. Currently, in specific implementation, an additional low-pass filter is added to work with the dielectric filter, to meet a requirement for the high-order harmonic wave frequency. Based on this, a dielectric filter and a communications device are designed in the embodiments of this application, so that a magnetic field generated in the designed dielectric filter is cut, thereby improving a high-order harmonic wave frequency and a remote suppression capability. Further, the base station and the terminal device that include the designed dielectric filter can better meet user requirements in a communication process, thereby improving user experience. In addition, the dielectric filter designed in the embodiments of this application is easy to implement and has a simple structure, and therefore has strong practicability. In this way, the additional low-pass filter is no longer required. Only the dielectric filter provided by the embodiments of this application is used, thereby reducing costs.

To describe the technical solutions in the embodiments of this application more clearly, the following describes in detail, with reference to the accompanying drawings, the dielectric filter and the communications device provided in the embodiments of this application.

This embodiment of this application provides a dielectric filter. As shown in a schematic structural diagram of the dielectric filter shown in FIG. 1, the dielectric filter includes at least two dielectric resonators, for example, a dielectric resonator 1, a dielectric resonator 2, and a dielectric resonator 3 shown in FIG. 1. A first through-hole is disposed between at least one pair of adjacent dielectric resonators, for example, a first through-hole 1 between the dielectric resonator 1 and the dielectric resonator 2, and a first through-hole 2 between the dielectric resonator 2 and the dielectric resonator 3 shown in FIG. 1.

It should be noted that, in the dielectric filter shown in FIG. 1, only a case in which a first through-hole is disposed between each pair of dielectric resonators is shown. Optionally, in FIG. 1, only the first through-hole 1 or only the first through-hole 2 may be disposed, that is, the first through-hole is disposed between only one pair of adjacent dielectric resonators. In other words, the first through-hole is disposed between some of the adjacent dielectric resonators. Details are not listed herein in this application.

Figure 2:
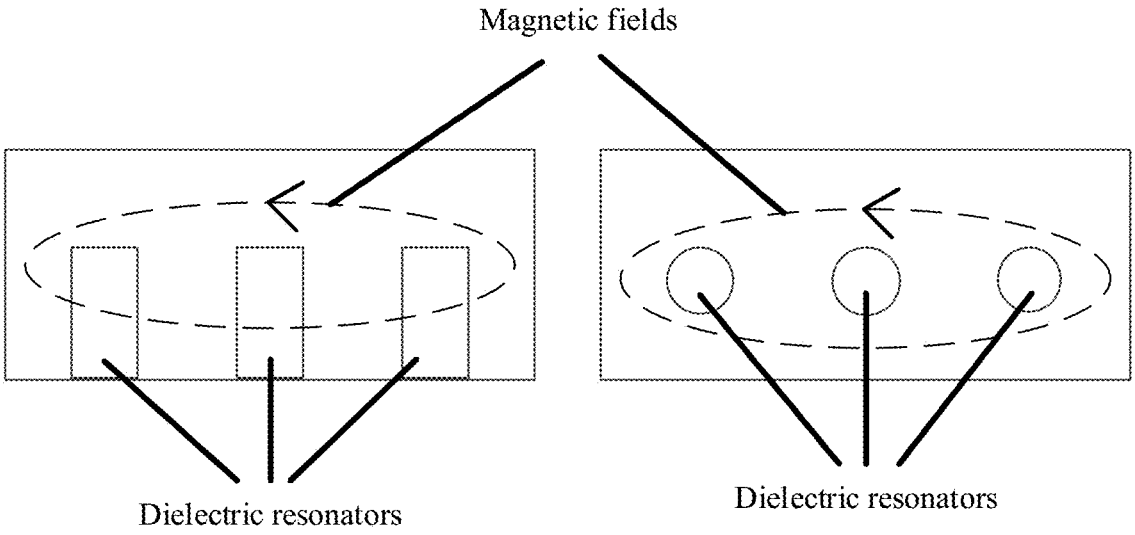
PRIOR ART FIG. 2
FIG. 2 is a schematic diagram of magnetic field distribution of a dielectric filter in the prior art.
Figure 3:
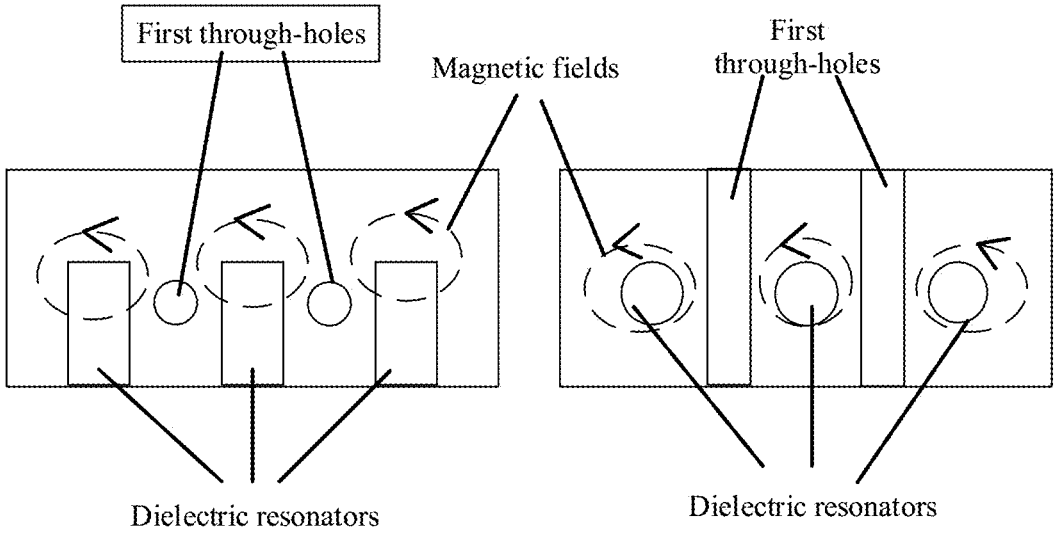
FIG. 3 is a schematic diagram of magnetic field distribution of a dielectric filter according to this application.

Specifically, the first through-hole is disposed between the at least one pair of adjacent dielectric resonators, so that the first through-hole cuts a magnetic field generated between the pair of adjacent dielectric resonators. For example, FIG. 2 is a schematic diagram of distribution of a magnetic field in a dielectric filter in the prior art, and FIG. 3 is a schematic diagram of distribution of a magnetic field in the dielectric filter according to an embodiment of this application. Compared with the magnetic field in FIG. 2, the magnetic field in FIG. 3 is cut. It can be obviously seen that a distribution area of the magnetic field in FIG. 2 is much larger than a distribution area of the magnetic field in FIG. 3. Therefore, by using the dielectric filter provided in embodiments of this application, a magnetic field distribution area can be reduced, so that a high-order harmonic wave frequency can be increased, and a remote suppression capability can be improved, thereby meeting specification requirements.

In an optional implementation, the first through-hole penetrates the dielectric filter, one opening of the first through-hole is located on a first surface and the other opening is located on a second surface; and the first surface and the second surface are respectively side surfaces on two sides of an arrangement direction of the at least two resonators in the dielectric filter. In this way, the first through-hole can cut a magnetic field between the pair of adjacent dielectric resonators.

For example, the first through-hole 1 in FIG. 1 is used as an example for description. It may be understood that the arrangement direction of the at least two dielectric resonators in the dielectric filter in FIG. 1 may be a direction from the dielectric resonator 1 to the dielectric resonator 2 and then to the dielectric resonator 3. The two sides of the arrangement direction are the first side and the second side shown in FIG. 1, the first surface is a side surface of the first side or a side surface of the second side, and the second surface is a side surface of a side other than the side for the first surface in the two sides. This is not specifically limited in this application. For example, one opening of the first through-hole 1 in FIG. 1 is located on the side surface of the first side of the dielectric filter, and the other opening is located on the side surface of the second side of the dielectric filter.

Figure 4:
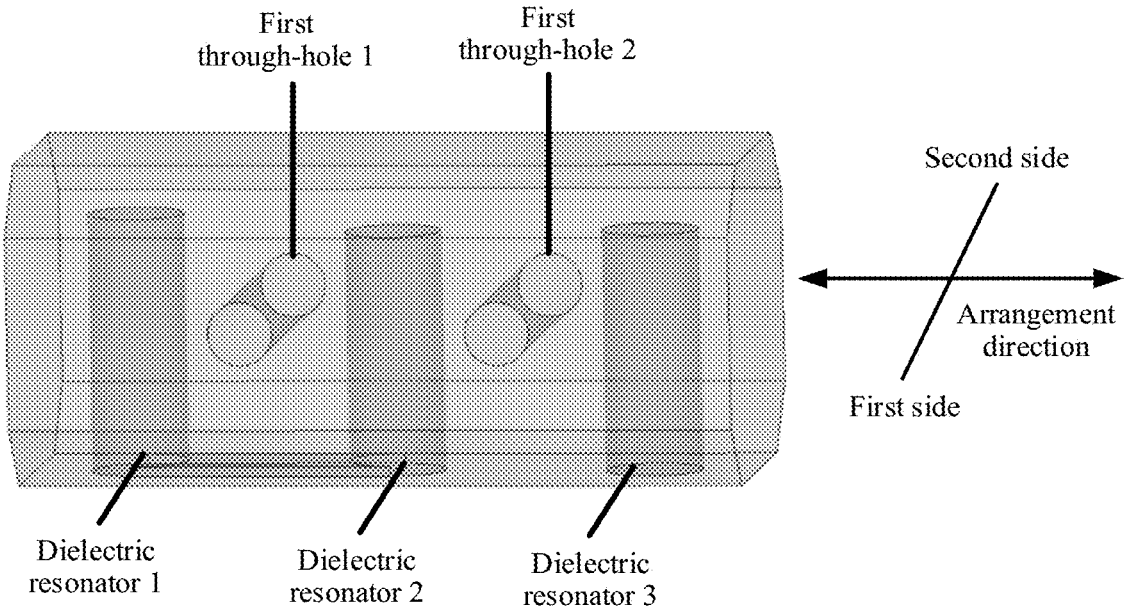
FIG. 4 is a schematic structural diagram of another dielectric filter according to this application.

It should be noted that FIG. 1 shows only a simplest and intuitive cuboid structure of the dielectric filter. Therefore, there is only one side surface on each of the first side and the second side in FIG. 1. However, it should be understood that FIG. 1 is merely an example. An existence form of the dielectric filter provided in the embodiments of this application is not limited to a cuboid, and may also be a polyhedron (with more than six sides). In this case, there may be a plurality of side surfaces on both the first side and the second side, one opening of the first through-hole 1 may be located on a side surface in the plurality of side surfaces of the first side, and the other opening may be located on a side surface in the plurality of side surfaces of the second side. This is not limited in this application. For example, FIG. 4 is a schematic structural diagram of a dielectric filter. In FIG. 4, there are three side faces on both the first side and the second side of the dielectric filter. One opening of the first through-hole 1 is located on a side surface of the first side, and the other opening is located on a side surface of the second side. The second through-hole 2 is similar, and details are not described herein again.

It should be noted that the foregoing listed existence forms of the dielectric filter are regular polyhedrons. In practice, the dielectric filter may also be irregular polyhedrons, that is, a quantity of side surfaces of the first side is different from a quantity of side surfaces of the second side, or a side surface is concave or convex, and the like. However, it only needs to be ensured that the two openings are located on any side surfaces of the two sides of the arrangement direction of the at least two dielectric resonators. Specifically, details are not listed one by one herein this application.

Figure 5:
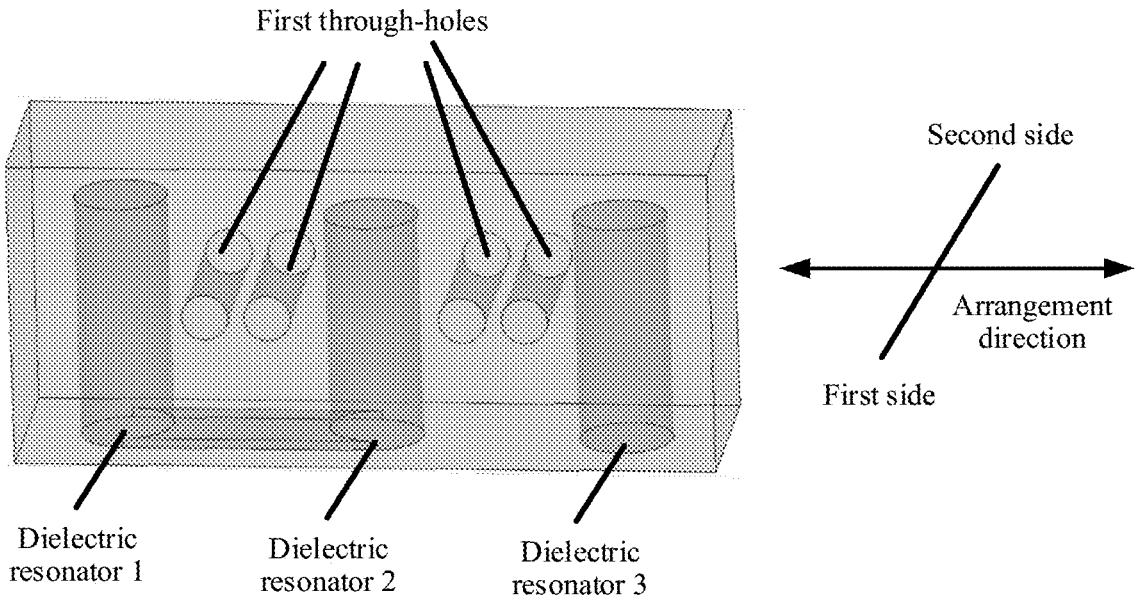
FIG. 5 is a schematic structural diagram of another dielectric filter according to this application.

In an optional implementation, one or more first through-holes are disposed between at least one pair of adjacent dielectric resonators. FIG. 1 shows an example in which only one first through-hole is disposed between two adjacent dielectric resonators. It should be understood that FIG. 1 does not constitute a limitation on this application. Specifically, there may be one or more first through-holes between a pair of adjacent dielectric resonators, and there may also be one or more first through-holes between another pair of adjacent resonators. For example, in FIG. 1, there may be only one first through-hole (that is, there may be only one first through-hole 1) between the dielectric resonator 1 and the dielectric resonator 2, and there may be a plurality of first through-holes between the dielectric resonator 2 and the dielectric resonator 3 (that is, there may be another first through-hole in addition to the first through-hole 2). For another example, in FIG. 1, there may be a plurality of first through-holes (that is, there may be another first through-hole in addition to the first through-hole 1) between the dielectric resonator 1 and the dielectric resonator 2, and there may be only one first through-hole (that is, there may be only the first through-hole 2) between the dielectric resonator 2 and the dielectric resonator 3. For example, FIG. 5 shows a case in which there are a plurality of first through-holes between a pair of dielectric resonators.

In the optional implementation, the first through-hole may be but is not limited to a straight-through hole, a bent-through hole, an irregular through-hole, or the like. In an optional implementation, when there are a plurality of first through-holes between the pair of adjacent dielectric resonators, some of the plurality of first through-holes may be straight-through holes, some may be bent-through holes, some may be irregular through-holes, or the like. Alternatively, all of the plurality of first through-holes may be straight-through holes, bent-through holes, irregular through-holes, or the like. This is not limited in this application.

In a possible implementation, the first through-hole is in communication with a through-hole group, and the through-hole group includes one or more second through-holes; and openings of all the second through-holes are located on a side surface close to the top or bottom of the at least two dielectric resonators in the dielectric filter. For example, in the schematic structural diagram of the dielectric filter shown in FIG. 6, the second through-hole 1 is a through-hole group in communication with the first through-hole 1, and the second through-hole 2 is a through-hole group in communication with the first through-hole 2. In addition, openings of both the second through-hole 1 and the second through-hole 2 are located on a side surface close to the top of the at least two dielectric resonators in the dielectric filter. It should be noted that, when each of a plurality of first through-holes is in communication with one through-hole group, openings of all the second through-holes in the plurality of through-hole groups are all on a side surface of the top, or are all on a side surface of the bottom, but cannot be located as follows: some openings are on a side surface of the top, and the other openings are on a side surface of the bottom, to avoid a short circuit of the dielectric filter.

Figure 6:
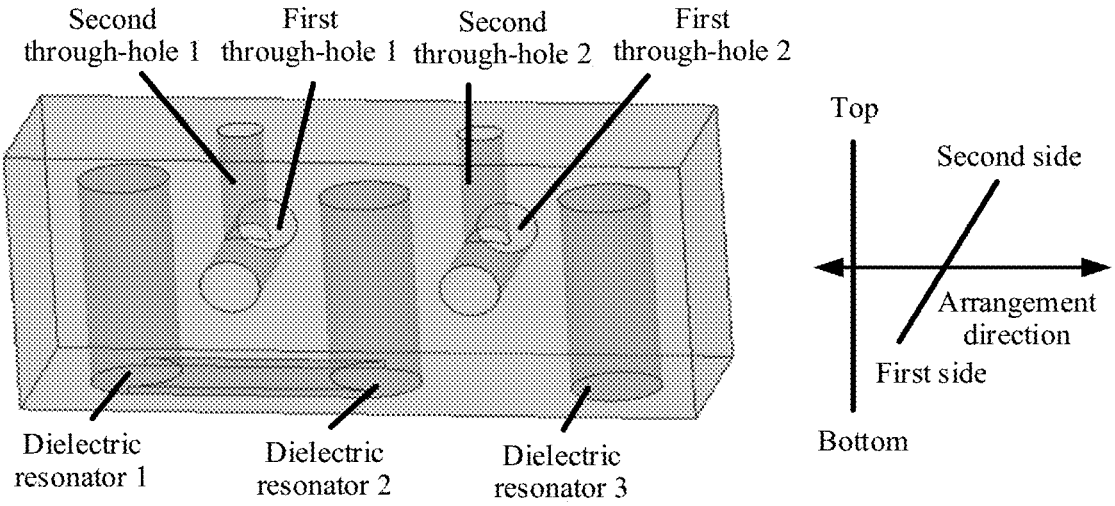
FIG. 6 is a schematic structural diagram of another dielectric filter according to this application.
Figure 7:
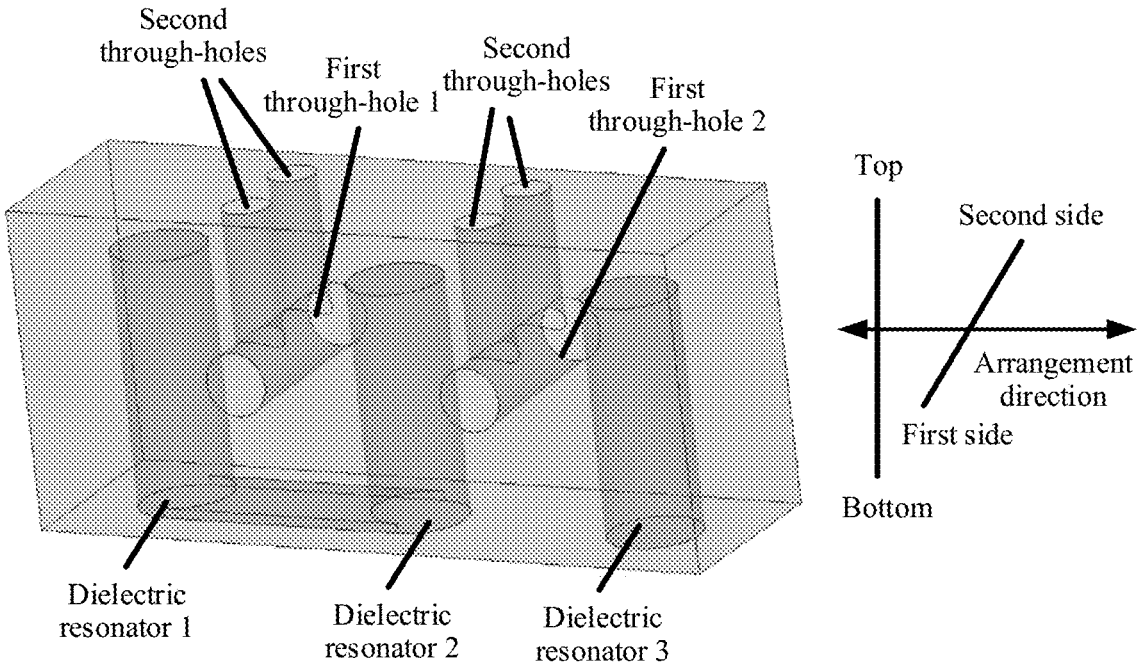
FIG. 7 is a schematic structural diagram of another dielectric filter according to this application.

FIG. 6 shows only a case in which there is only one second through-hole in the through-hole group in communication with the first through-hole. Certainly, the first through-hole 1 may be in communication with a plurality of second through-holes, and the first through-hole 2 is in communication with a plurality of second through-holes, or one of the first through-hole 1 and the second through-hole 2 is in communication with one second through-hole, and the other is in communication with a plurality of second through-holes, which are not listed one by one herein. For example, FIG. 7 shows a case in which the through-hole group in communication with the first through-hole 1 includes two second through-holes (that is, a plurality of second through-holes), and the through-hole group in communication with the first through-hole 2 includes two second through-holes (that is, a plurality of second through-holes).

Figure 8:
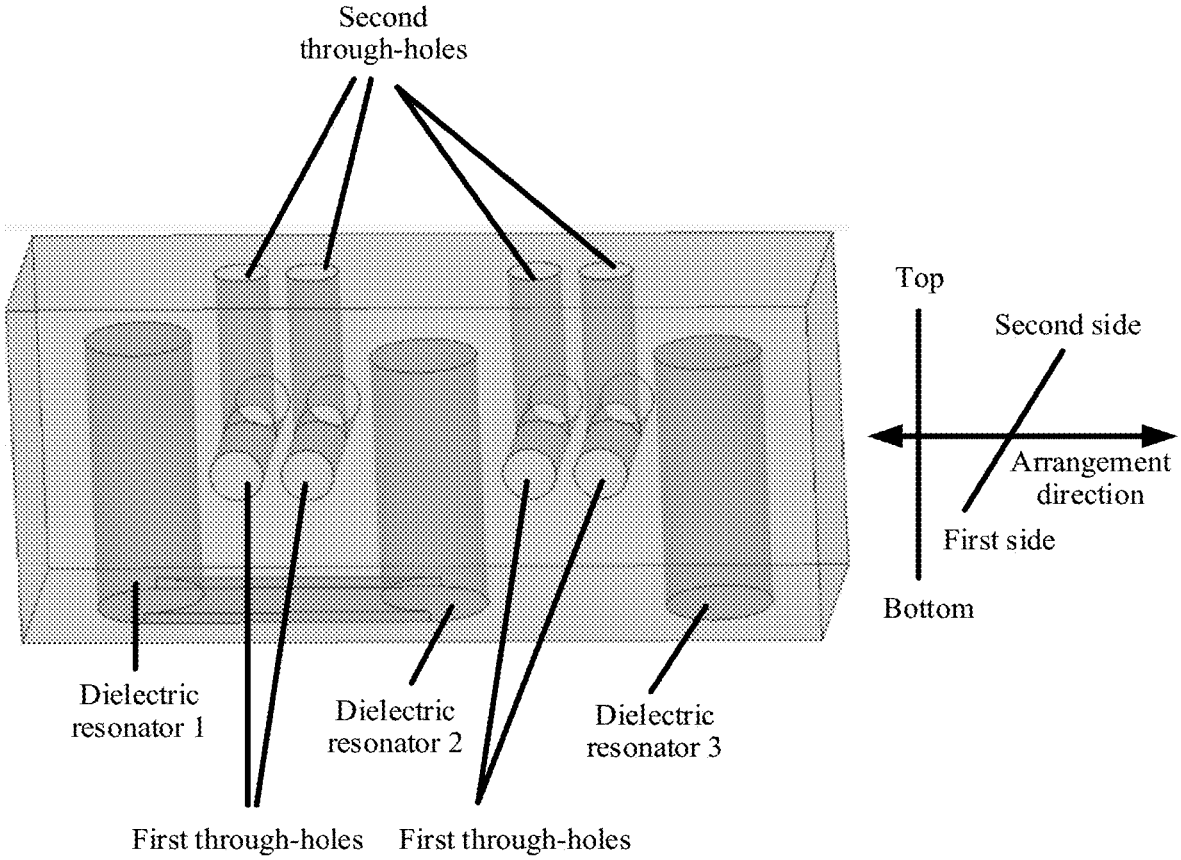
FIG. 8 is a schematic structural diagram of another dielectric filter according to this application.

In an optional implementation, when there are a plurality of first through-holes between a pair of adjacent dielectric resonators, each first through-hole may be in communication with a through-hole group, that is, each first through-hole may be in communication with at least one second through-hole. For example, FIG. 8 shows such a schematic structural diagram of the dielectric filter.

Figure 9:
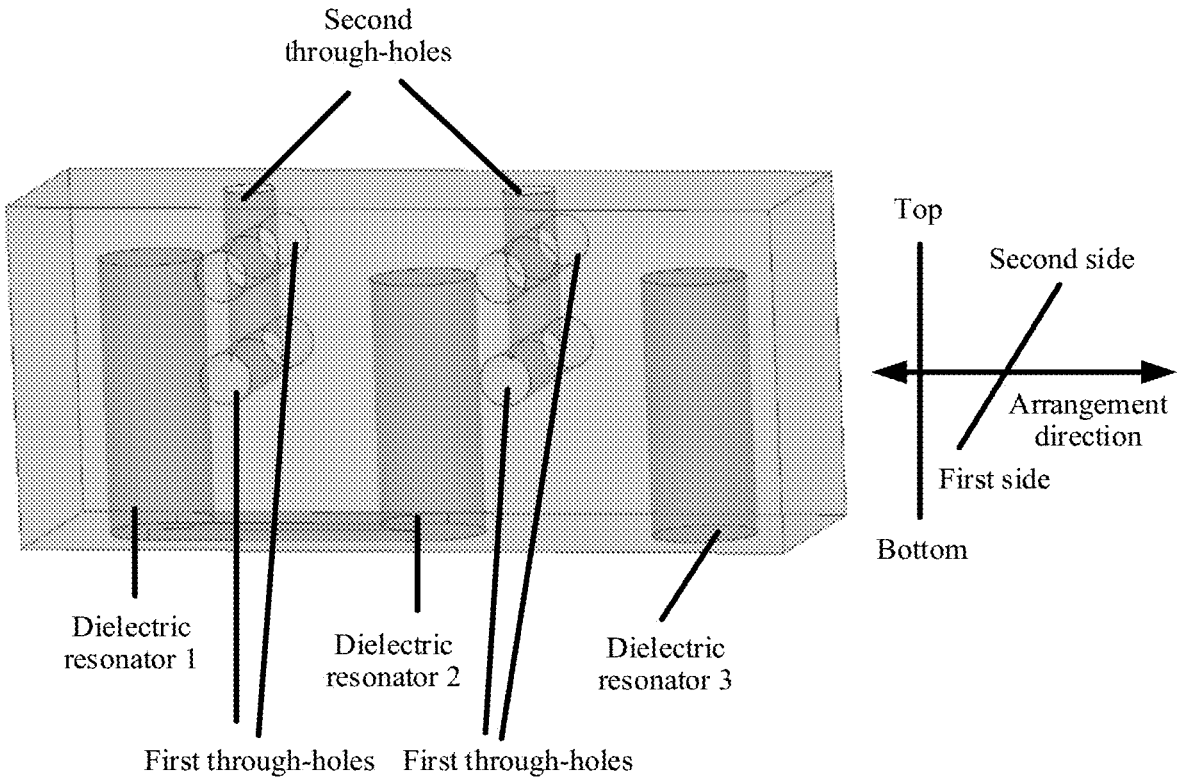
FIG. 9 is a schematic structural diagram of another dielectric filter according to this application.
Figure 10:
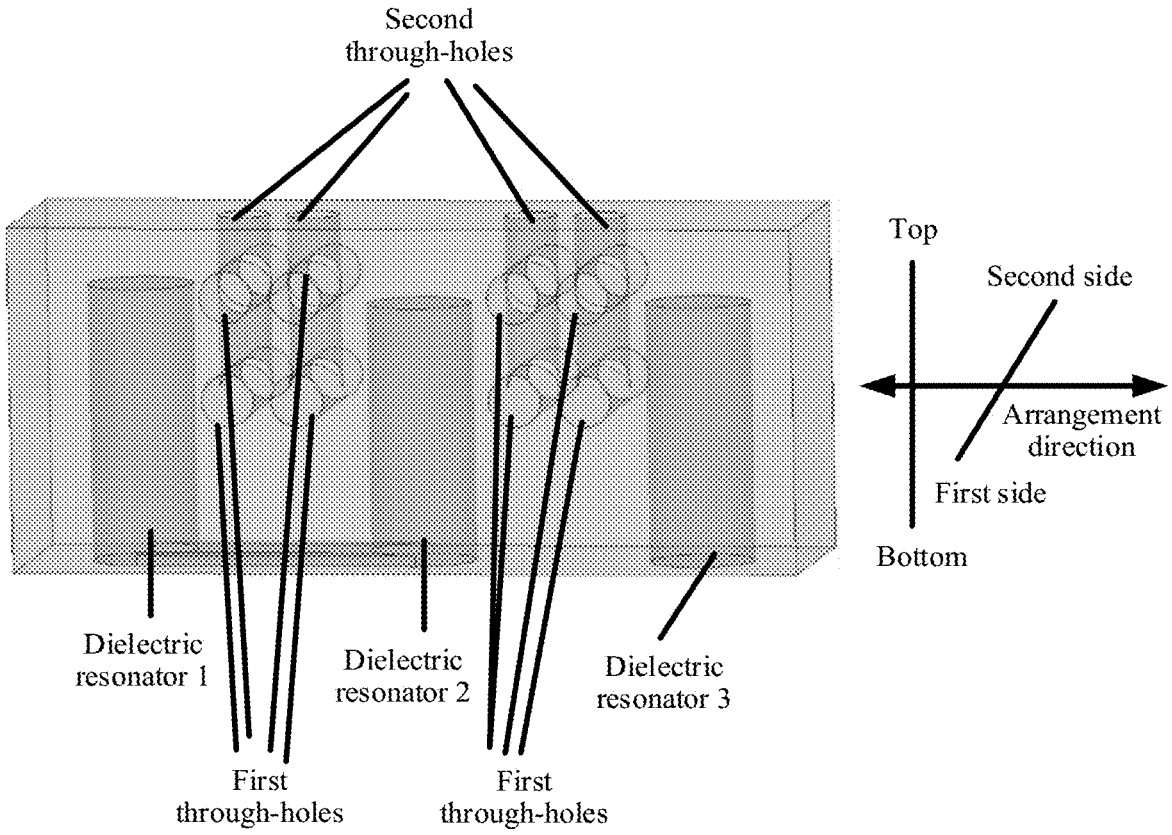
FIG. 10 is a schematic structural diagram of another dielectric filter according to this application.
Figure 11:
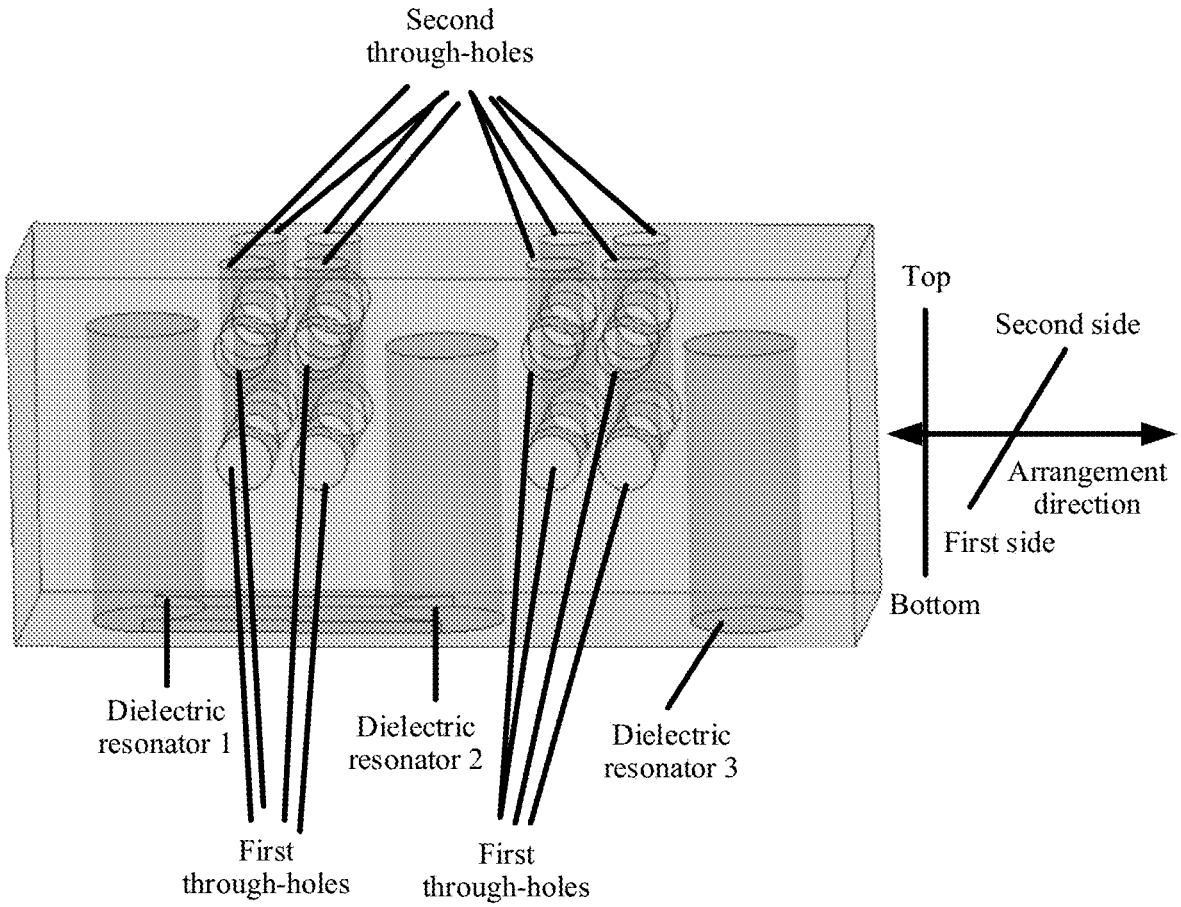
FIG. 11 is a schematic structural diagram of another dielectric filter according to this application.

In an optional implementation, when there are a plurality of first through-holes between a pair of adjacent dielectric resonators, a connection relationship between the plurality of first through-holes and at least one second through-hole may alternatively be shown in FIG. 9, FIG. 10, or FIG. 11. Certainly, there may be another structure, which is not listed one by one herein.

In an optional implementation, when there are a plurality of first through-holes between a pair of adjacent dielectric filters, some first through-holes in the plurality of first through-holes may be in communication with a through-hole group, and the remaining first through-holes are not in communication with a through-hole group. In another optional implementation, when a first through-hole is disposed between a plurality of pairs of adjacent dielectric resonators, first through-holes between some pairs of adjacent dielectric resonators may be in communication with a through-hole group, and first through-holes of the other several pairs of adjacent dielectric resonators are not in communication with a through-hole group. This is not limited in this application.

The first through-hole is in communication with the through-hole via the through-hole group, so that a magnetic field cutting capability is stronger than that when only the first through-hole is disposed, and the high-order harmonic wave frequency can be further increased.

Figure 12:
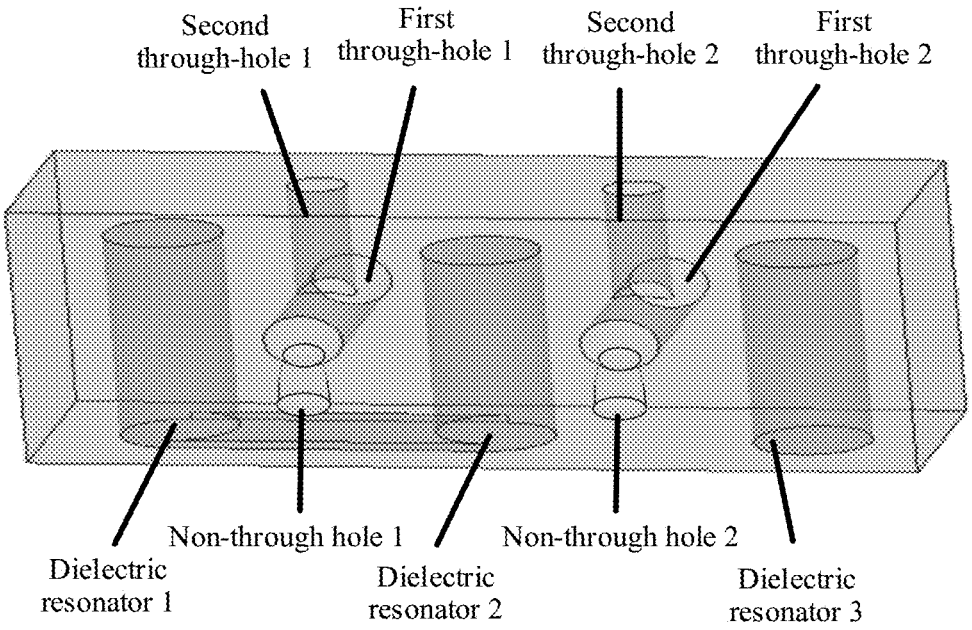
FIG. 12 is a schematic structural diagram of another dielectric filter according to this application.
Figure 13:
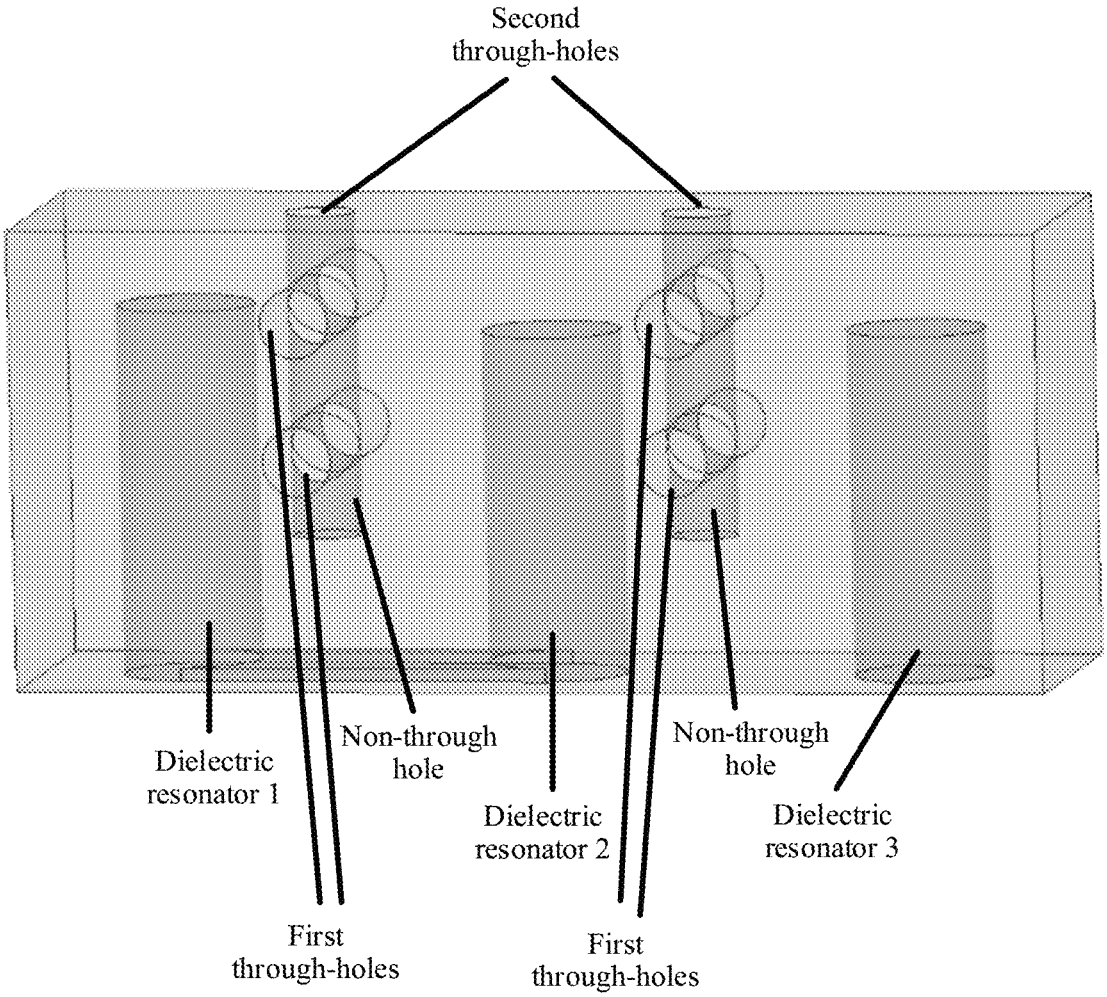
FIG. 13 is a schematic structural diagram of another dielectric filter according to this application.
Figure 14:
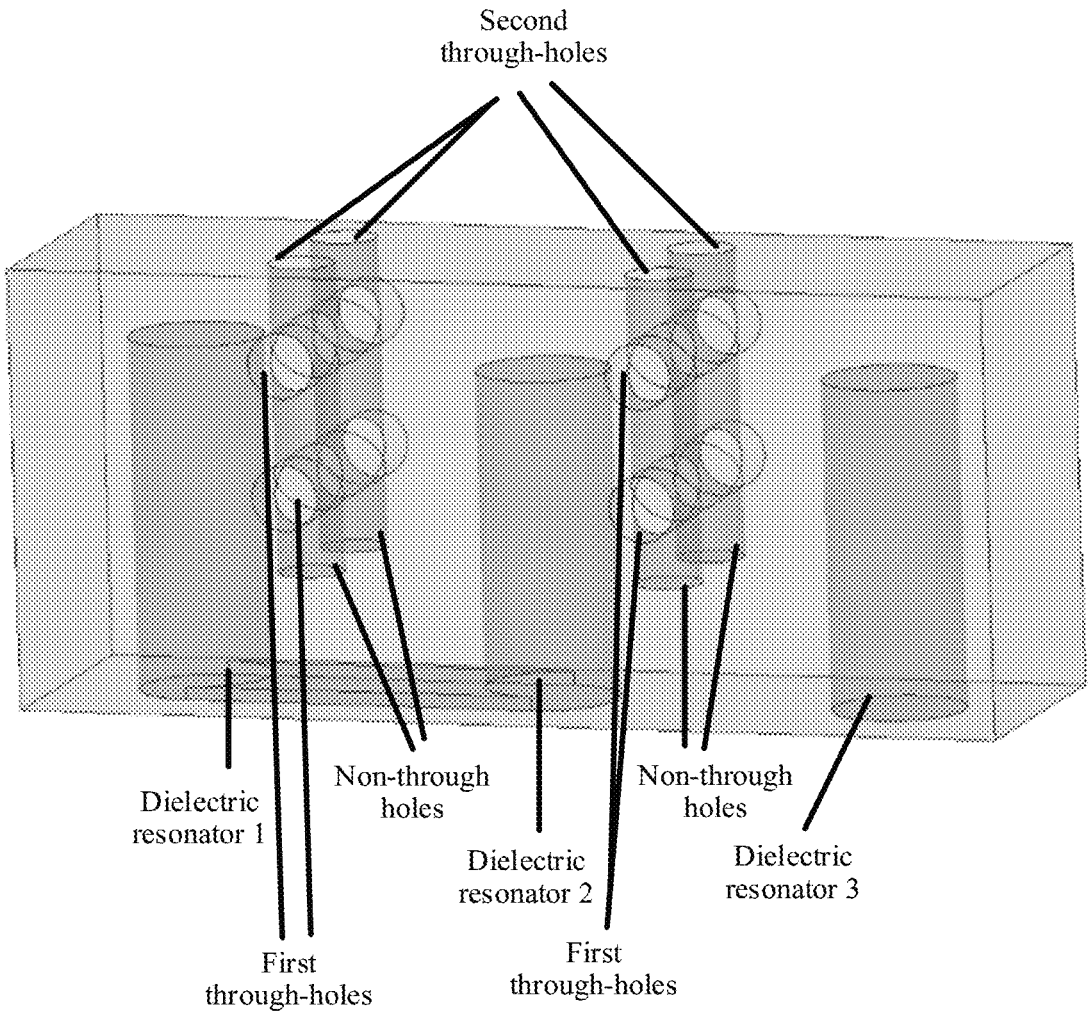
FIG. 14 is a schematic structural diagram of another dielectric filter according to this application.
Figure 15:
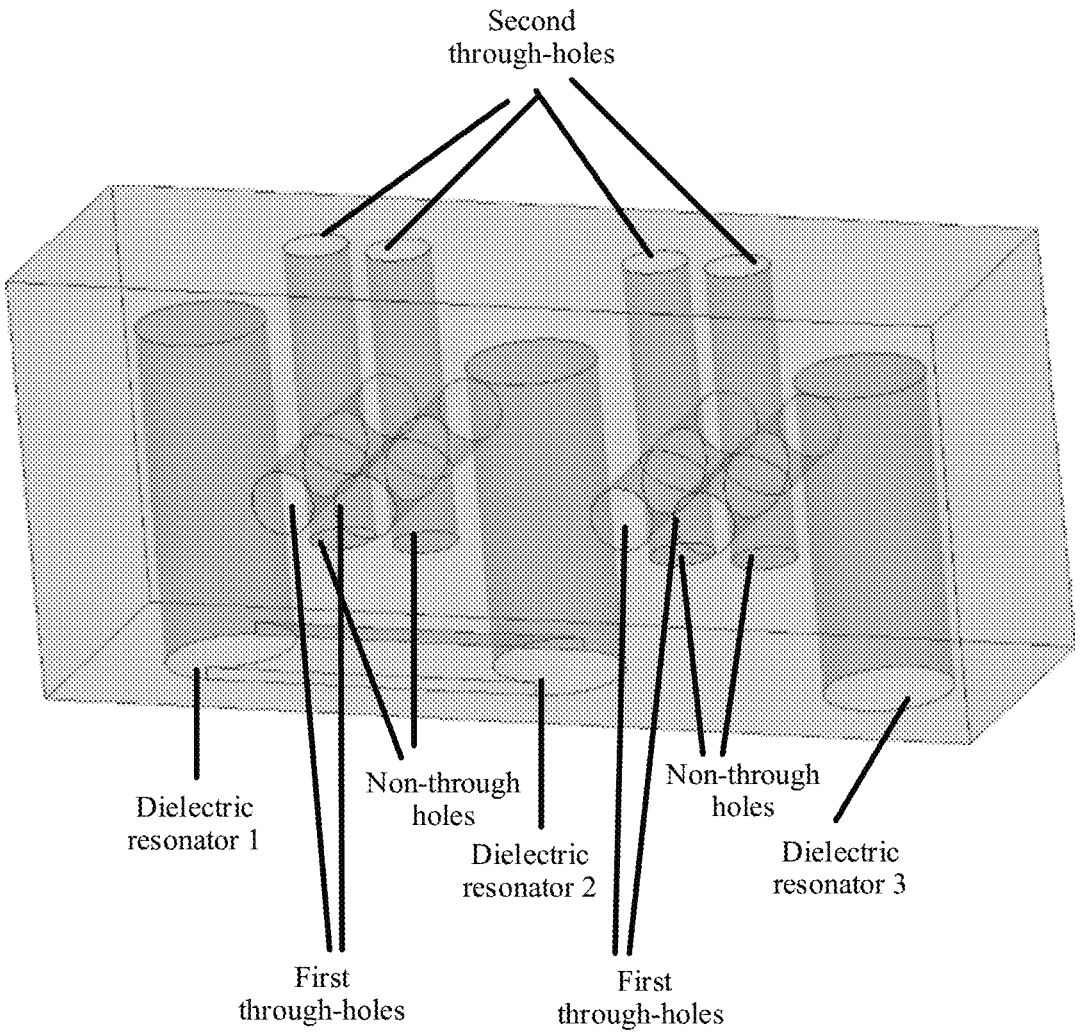
FIG. 15 is a schematic structural diagram of another dielectric filter according to this application.
Figure 16:
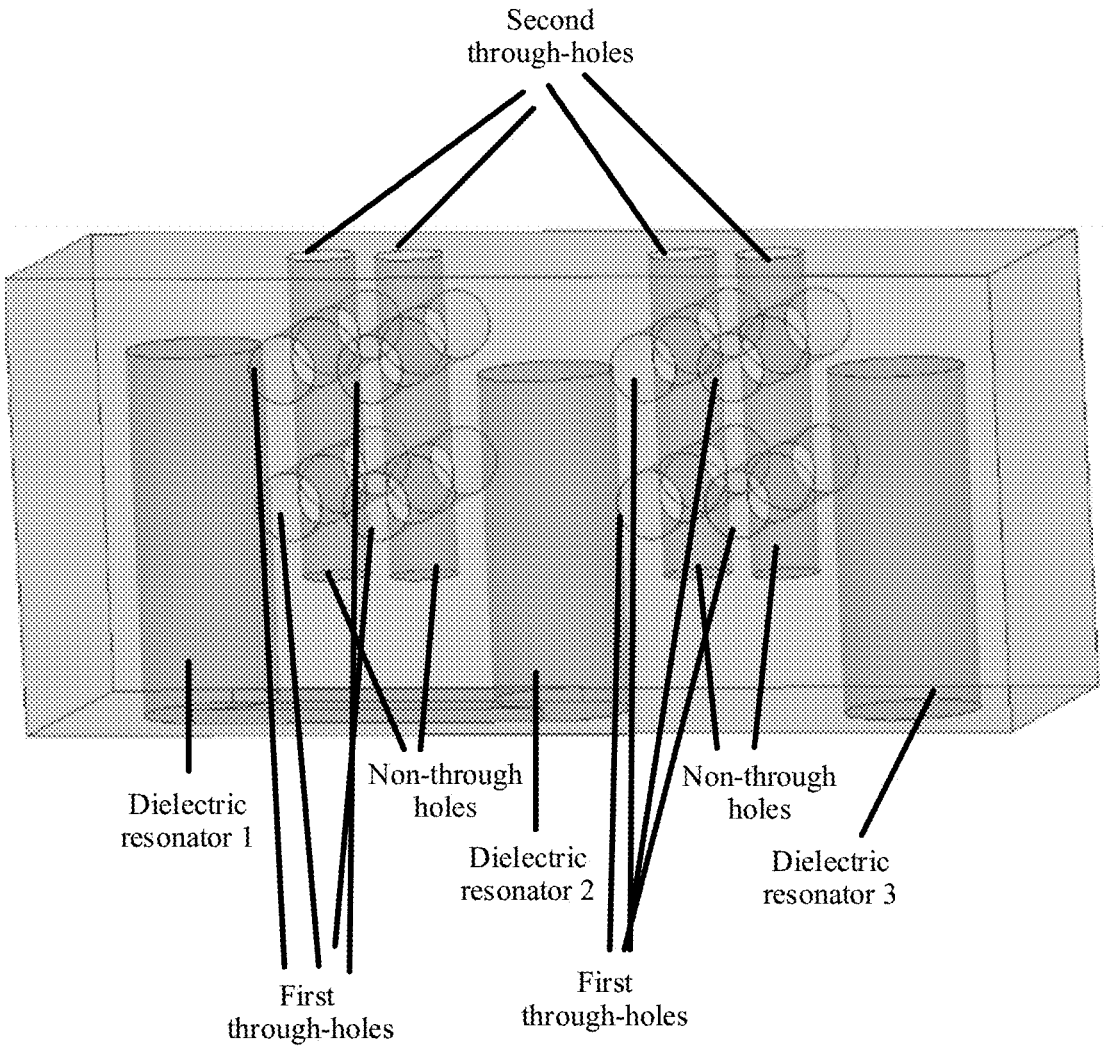
FIG. 16 is a schematic structural diagram of another dielectric filter according to this application.
Figure 17:
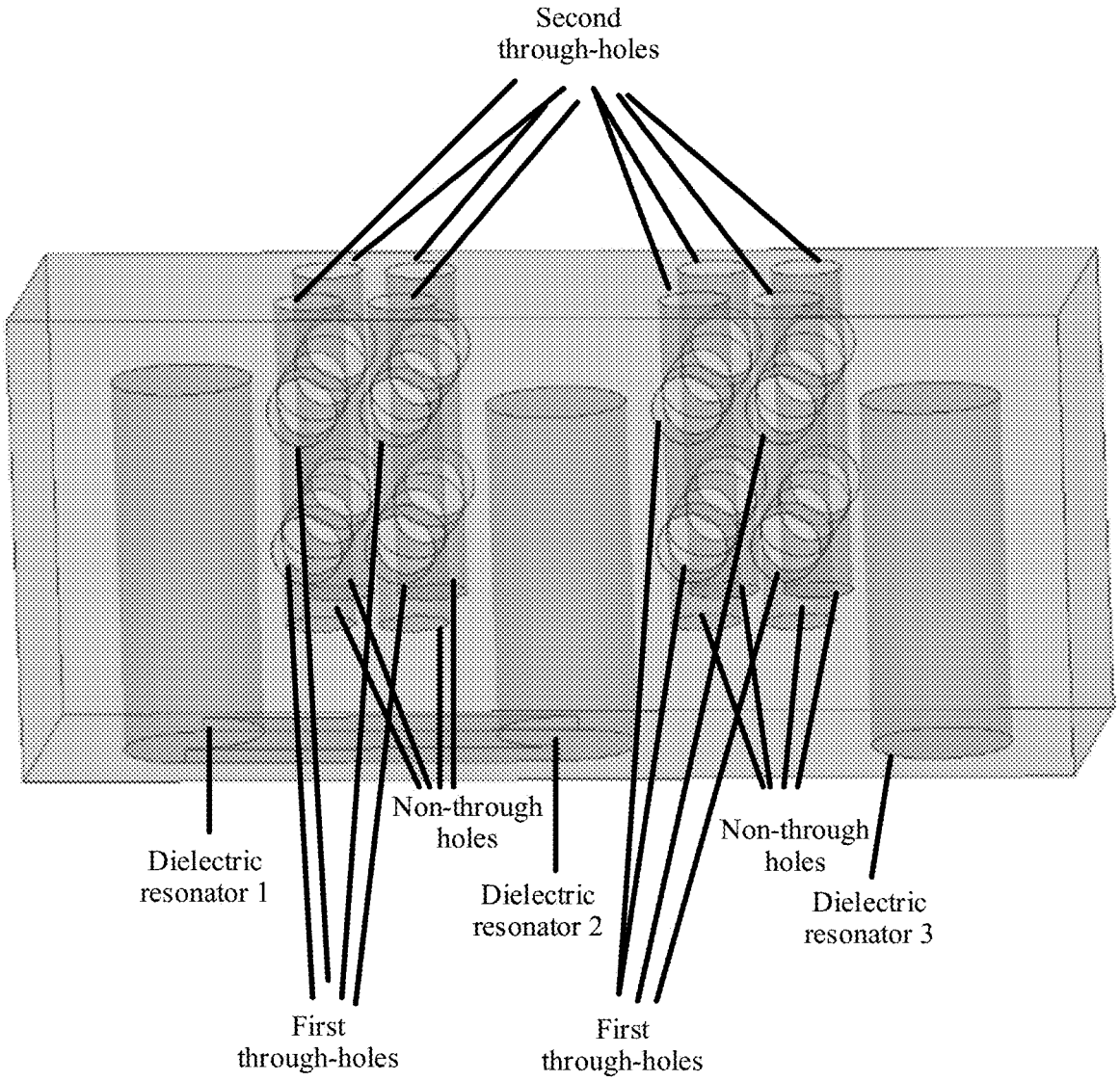
FIG. 17 is a schematic structural diagram of another dielectric filter according to this application.

In a possible design, at least one non-through hole is disposed on a first through-hole, and a non-through hole is in communication with a second through-hole. For example, in a schematic structural diagram of a dielectric filter shown in FIG. 12, a non-through hole 1 is disposed on a first through-hole 1 and is in communication with a second through-hole 1. A non-through hole 2 is disposed on a first through-hole 2 and is in communication with a second through-hole 2.

In an optional implementation, when a through-hole group in communication with a first through-hole includes a plurality of second through-holes, a quantity of at least one non-through hole disposed on the first through-hole may be less than or equal to a quantity of the plurality of second through-holes. To be specific, when the quantity of the at least one non-through hole is equal to the quantity of the second through-holes, each second through-hole in the plurality of second through-holes is in communication with one non-through hole; when the quantity of the at least one non-through hole is less than the quantity of the second through-holes, each second through-hole of some (a quantity of these second through-holes is equal to a quantity of non-through holes) of the plurality of second through-holes is separately in communication with a non-through hole, and the other second through-holes are not in communication with a non-through hole.

In an optional implementation, when there are a plurality of first through-holes between at least one pair of adjacent dielectric resonators, and at least one second through-hole is in communication with each of the plurality of first through-holes, a relationship among the first through-holes, the second through-holes, and the non-through holes may be as shown in schematic diagrams of the dielectric filter shown in FIG. 13, FIG. 14, FIG. 15, FIG. 16, and FIG. 17. Certainly, there may be another structure, which is not listed one by one herein.

In an optional implementation, each non-through hole in communication with a second through-hole may be considered as a case in which the second through-hole continues to penetrate the first through-hole after being connected to the first through-hole but does not reach a side surface of the dielectric filter, that is, the non-through hole may be considered as a part of the second through-hole.

In an optional implementation, the at least one first through-hole, the at least one second through-hole, and the at least one non-through hole may be coated with metal materials. The metal materials may be the same or may be different from each other. This is not limited in this application. Optionally, the metal materials may be silver, copper, or the like.

Figure 18:
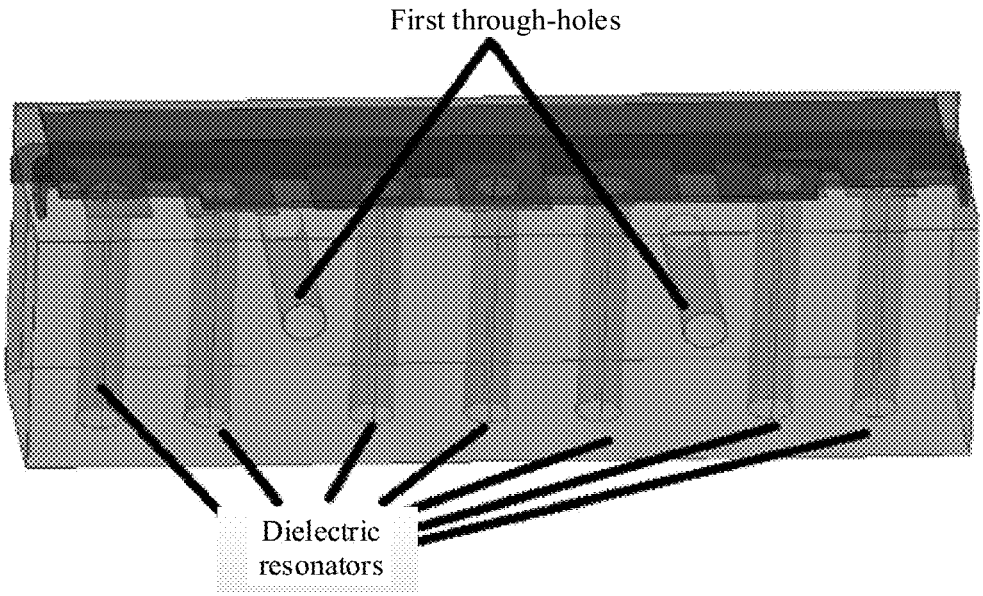
FIG. 18 is an example diagram of a dielectric filter according to this application.

In an optional implementation, the dielectric filter may be a TEM-type dielectric filter. For example, FIG. 18 shows a possible structure example of the TEM-type dielectric filter, which is used to increase the high-order harmonic wave frequency of the TEM-type dielectric filter.

It should be noted that in the schematic diagram of the dielectric filter shown in the embodiments of this application, the first through-hole, the second through-hole, and the non-through hole are all shown in circular holes as an example. It should be understood that this is merely an example. Optionally, the first through-hole, the second through-hole, and the non-through hole may all be square holes, step holes, irregular holes, or the like. This is not limited in this application. The step holes are formed by cascading holes with different diameters. It should be understood that, in the schematic diagram of the dielectric filter shown in the embodiments of this application, circular holes in the first through-hole, the second through-hole, and the non-through hole may be replaced with holes of any shapes such as square holes, step holes, and irregular shape holes. Details are not shown in this application.

Similarly, it should be noted that the dielectric resonators in the dielectric filter shown in the embodiments of this application are all shown as cylinders, and this is merely an example. The dielectric resonators are not limited to be cylinders, and may be in any other shape.

According to the dielectric filter provided in the embodiments of this application, because a first through-hole is disposed between at least one pair of adjacent dielectric resonators to cut a magnetic field between the adjacent dielectric resonators, a high-order harmonic frequency and a remote suppression capability can be improved. Therefore, the dielectric filter provided in the embodiments of this application meets the specification requirements, and no additional low-pass filter needs to be used to work with the dielectric filter to meet the specification requirements. In this way, unnecessary loss can be avoided, and costs can be reduced. The dielectric filter structure designed by the embodiments of this application is simple and easy to implement, so it is very practical.

Based on the foregoing embodiments, this embodiment of this application also provides a communications device, where the communications device includes the dielectric filter described in the foregoing embodiments. For a detailed description of the dielectric filter, refer to the foregoing embodiments. Details are not described herein again. In an optional implementation, the communications device may be but is not limited to a base station, a terminal device, or the like.

Based on the foregoing embodiments, the high-order harmonic wave frequencies corresponding to the dielectric filter (a communications device) shown in FIG. 1 (only a first through-hole is disposed) and FIG. 6 (a first through-hole is in communication with a through-hole group) provided in the embodiments of this application and an existing dielectric filter in a same scenario are described as follows:

TABLE 1

| | Dielectric filter type | | |
|---|---|---|---|
| | Existing dielectric filter | Dielectric filter shown in FIG. 1 | Dielectric filter shown in FIG. 4 |
| High-order harmonic wave frequency | 4.86 GHZ | 6.29 GHZ | 6.62 GHZ |

Table 1 briefly describes the high-order harmonic wave frequency corresponding to the existing dielectric filter, the dielectric filter provided by the embodiment of this application shown in FIG. 1, and the dielectric filter provided by the embodiment of this application shown in FIG. 6. It can be learned from Table 1 that the high-order harmonic wave frequency generated by using the dielectric filter provided in the embodiments of this application is higher than the high-order harmonic wave frequency generated by using the existing dielectric filter. In other words, the high-order harmonic wave frequency generated by using the dielectric filter shown in FIG. 1 is increased by 1.43 GHz compared with that of the existing dielectric filter. The high-order harmonic wave frequency of the dielectric filter shown in FIG. 6 is increased by 1.76 GHz compared with that of the existing dielectric filter. Therefore, it can be proved that the high-order harmonic wave frequency can be increased by using the dielectric filter provided in the embodiments of this application.

Further, it may be further learned from Table 1 that the high-order harmonic wave frequency generated by using the dielectric filter provided by the embodiment of this application shown in FIG. 6 is higher than the high-order harmonic wave frequency generated by using the dielectric filter provided by the embodiment of this application shown in FIG. 1. Therefore, the dielectric filter on which the through-hole group in communication with the first through-hole is disposed has a better effect of improving the high-order harmonic wave frequency than the dielectric filter on which only the first through-hole is disposed.

Although some preferred embodiments of the present application have been described, a person skilled in the art can make changes and modifications to these embodiments once they learn the basic inventive concept. Therefore, the following claims are intended to be construed as to cover the preferred embodiments and all changes and modifications falling within the scope of this application.

Obviously, a person skilled in the art can make various modifications and variations to embodiments of this application without departing from the scope of this application. This application is intended to cover these modifications and variations provided that they fall within the scope of protection defined by the following claims and their equivalent technologies.

What is claimed is:

1. A dielectric filter, comprising a first dielectric resonator, a second dielectric resonator, and a third dielectric resonator, wherein the first dielectric resonator is adjacent to the second dielectric resonator, and the third dielectric resonator is adjacent to the second dielectric resonator, wherein a first through-hole is disposed between the first and the second dielectric resonators and there is no through-hole disposed between the second and the third dielectric resonators, and the first through-hole is configured to cut a magnetic field between the first and the second dielectric resonators.

2. The dielectric filter according to claim 1, wherein the first through-hole penetrates the dielectric filter, one opening of the first through-hole is located on a first surface, and the other opening is located on a second surface; and the first surface and the second surface are respectively side surfaces on two sides of an arrangement direction of the first and the second dielectric resonators in the dielectric filter.

3. The dielectric filter according to claim 1, wherein an internal surface of the first through-hole is coated with a first metallic material.

4. The dielectric filter according to claim 1, wherein the first through-hole is a straight-through hole or a bent-through hole.

5. The dielectric filter according to claim 1, wherein a shape of the first through-hole is a circular hole, a square hole, or a step hole.

6. The dielectric filter according to claim 1, wherein one or more first through-holes are disposed between the first and the second dielectric resonators.

7. The dielectric filter according to claim 1, wherein the dielectric filter is a TEM-type dielectric filter.

8. The dielectric filter according to claim 1, wherein the first through-hole is in communication with a through-hole group, and the through-hole group comprises one or more second through-holes; and openings of the second through-holes are located on a side surface close to a top or a bottom of the at least two dielectric resonators in the dielectric filter.

9. The dielectric filter according to claim 8, where an internal surface of at least one of the one or more second through-holes is coated with a first metallic material.

10. The dielectric filter according to claim 8, wherein a shape of at least one of the one or more second through-holes is a circular hole, a square hole, or a step hole.

11. The dielectric filter according to claim 8, wherein at least one non-through hole is disposed on the first through-hole, and one non-through hole is in communication with one second through-hole.

12. The dielectric filter according to claim 11, wherein an internal surface of the at least one non-through hole is coated with a second metallic material.

13. The dielectric filter according to claim 11, wherein a shape of the at least one non-through hole is a circular hole, a square hole, or a step hole.

14. A communications device, comprising:

a dielectric filter, wherein the dielectric filter comprises a first dielectric resonator, a second dielectric resonator, and a third dielectric resonator, wherein the first dielectric resonator is adjacent to the second dielectric resonator, and the third dielectric resonator is adjacent to the second dielectric resonator, wherein a first through-hole is disposed between the first and the second dielectric resonators and there is no through-hole disposed between the second and the third dielectric resonators, and the first through-hole is configured to cut a magnetic field between the first and the second dielectric resonators.

15. The communications device according to claim 14, wherein the first through-hole penetrates the dielectric filter, one opening of the first through-hole is located on a first surface, and the other opening is located on a second surface; and the first surface and the second surface are respectively side surfaces on two sides of an arrangement direction of the first and the second dielectric resonators in the dielectric filter.

16. The communications device according to claim 14, wherein the first through-hole is a straight-through hole or a bent-through hole.

17. The communications device according to claim 14, wherein a shape of the first through-hole is a circular hole, a square hole, or a step hole.

18. The communications device according to claim 14, wherein the dielectric filter is a TEM-type dielectric filter.

19. The communications device according to claim 14, wherein the first through-hole is in communication with a through-hole group, and the through-hole group comprises one or more second through-holes; and openings of the second through-holes are located on a side surface close to a top or a bottom of the at least two dielectric resonators in the dielectric filter.

20. The communications device according to claim 19, where an internal surface of at least one of the one or more second through-holes is coated with a first metallic material.

* * * * *